US006860030B1

(12) United States Patent
Graf et al.

(10) Patent No.: US 6,860,030 B1
(45) Date of Patent: Mar. 1, 2005

(54) CONTROL SYSTEM FOR GAP MEASURING

(75) Inventors: Edwin X. Graf, Menasha, WI (US); James A. Eng, Appleton, WI (US); David W. Root, Marshfield, WI (US)

(73) Assignee: Voith Paper, Inc., Appleton, WI (US)

( * ) Notice: Subject to any disclaimer, the term of this patent is extended or adjusted under 35 U.S.C. 154(b) by 0 days.

(21) Appl. No.: 09/713,434

(22) Filed: Nov. 15, 2000

(51) Int. Cl.[7] ..... G01B 7/14; G01L 5/00; D21F 3/00

(52) U.S. Cl. ..... 33/700; 162/358.3; 73/862.55

(58) Field of Search ..... 33/700, 701, 732, 33/733, DIG. 2, 613, 623; 101/425; 226/195; 162/358.1, 358.3, 290; 73/824, 825, 818, 862.55; 100/47, 162 B

(56) References Cited

U.S. PATENT DOCUMENTS 3,119,324 A * 1/1964 Justus ..... 100/170
3,853,698 A * 12/1974 Mohr ..... 162/358
4,023,480 A * 5/1977 Biondetti ..... 100/162 B
4,074,624 A * 2/1978 Biornstad et al. ..... 100/35
4,091,673 A * 5/1978 Tamura et al. ..... 374/120
4,357,743 A * 11/1982 Hefter et al. ..... 29/116 AD
4,480,537 A * 11/1984 Agronin et al. ..... 100/47
4,559,106 A * 12/1985 Skytta et al. ..... 162/358
4,568,423 A * 2/1986 Laapotti ..... 162/358
4,625,568 A * 12/1986 Hartung et al. ..... 73/862.55
4,791,863 A * 12/1988 Vahatalo ..... 100/47
4,793,250 A * 12/1988 Niskanen ..... 100/162 B
4,898,012 A * 2/1990 Jones et al. ..... 72/11
5,379,652 A * 1/1995 Allonen ..... 73/862.55
5,383,371 A * 1/1995 Laitinen ..... 73/862.55
5,562,027 A * 10/1996 Moore ..... 73/862.55
5,592,875 A * 1/1997 Moschel ..... 73/862.55
5,629,487 A * 5/1997 Mucke et al. ..... 73/862.55
5,699,729 A * 12/1997 Moschel ..... 73/862.55
5,798,024 A * 8/1998 Odell et al. ..... 162/203
5,830,316 A * 11/1998 Ampulski ..... 162/117
5,953,230 A * 9/1999 Moore ..... 162/252
6,228,222 B1 * 5/2001 Meschenmoser et al. 162/360.3
6,306,258 B1 * 10/2001 Lange et al. ..... 162/290
6,387,218 B1 * 5/2002 Graf ..... 162/358.3
6,419,793 B1 * 7/2002 Beck ..... 162/213
6,485,612 B1 * 11/2002 Graf ..... 162/358.1
2002/0060018 A1 * 5/2002 Lindsay et al. ..... 162/198

* cited by examiner

*Primary Examiner*—Christopher W. Fulton
*Assistant Examiner*—Mirellys Jagan
(74) *Attorney, Agent, or Firm*—Taylor & Aust, P.C

(57) ABSTRACT

A control system for measuring a gap in an apparatus for pressing a traveling paper web as the paper web travels through the gap accompanied by at least one belt or felt, the apparatus including a press apparatus and a support surface defining a gap therebetween. A frame is provided for moveably supporting the press apparatus. An actuator is operatively disposed between the frame and press apparatus for selectively moving the press apparatus toward and away from the support to control the gap size. A transducer is mounted in either the press apparatus or support for producing a signal indicative of the pressure on the paper web as the paper web, belt and felt pass through the gap beneath the transducer. A controller is operatively linked with the transducer for receiving the signal, determining the measure of the gap as a function of the pressure, and causing the actuator to selectively move the press apparatus to control the gap size.

13 Claims, 3 Drawing Sheets

CONTROL SYSTEM FOR GAP MEASURING

BACKGROUND OF TIE INVENTION

1. Field of the Invention

The present invention relates to the measurement of a gap between nipped components through which a paper web is being passed, and, more particularly, this invention relates to a system for measuring the nip gap in a paper-making press apparatus through which a traveling flexible material is passed for dewatering the paper web.

2. Description of the Related Art

In the press section of a paper-making machine, water is typically removed mechanically by passing the paper web through a nip between structural components, such as two rotating rolls. The nascent paper web is carried on a felt for absorbing the water expressed from the paper web as it passes through the nip.

One of the characteristics of a quality paper product is uniformity of caliper in a cross-machine direction of the paper-making machine. Such uniformity of caliper is difficult to obtain, particularly in bulky products, such as tissue and towel grades, due to deflection of machine components caused by gravity.

Rolls of different design, such as control-deflection rolls and plain rolls, deflect different amounts along their lengths extending in a cross-machine direction. A non-uniform gap, or uneven gap loading in the cross-machine direction, will produce undesirable variations in both caliper and moisture in the web passing through on its way to the dryer section. Such variations undesirably affect the processing of the web, such as by requiring costly special profiling downstream of the press section, increasing expensive thermal removal moisture in the dryer section, or slowing the entire paper-making machine.

What is needed in the art is a way of measuring the gap between the surface which presses the belt against the support surface and signals that measurement so that the gap can be changed or adjusted according to predetermined design parameters.

SUMMARY OF THE INVENTION

The present invention provides one or more transducers mounted in the press for measuring the gap between press elements mounted on either side of the traveling belt, paper web and felt.

The present invention comprises, in one form thereof, a control system for measuring a gap in an apparatus for pressing a traveling paper web as the paper web travels through the gap accompanied by at least one belt or felt, the apparatus including a press apparatus and a support surface defining a gap therebetween. A frame is provided for moveably supporting the press apparatus. An actuator is operatively disposed between the frame and press apparatus for selectively moving the press apparatus toward and away from the support to control the gap size. A transducer is mounted in either the press apparatus or support for producing a signal indicative of the pressure on the paper web as the paper web, belt and felt pass through the gap beneath the transducer. A controller is operatively linked with the transducer for receiving the signal, determining the measure of the gap as a function of the pressure, and causing the actuator to move the press apparatus to control the gap size, as desired.

This system thereby controls the cross-machine uniformity of the sealing or pressing nip. Such uniformity results in the least sealing nip for the pressing operation commensurate with optimal water removal and maintenance of the desired, uniform paper web caliper at a given speed. Cross-machine non-uniformity in the paper web in the form of wet streaks is controlled, and bulk in tissue paper grades is maximized because the nip load is dispersed as evenly as possible over the entire operating face which extends along the axial length of the support roll.

Accordingly, an advantage of the invention is to provide a system for measuring the gap and apparatus for processing a traveling paper web in a paper-making machine.

Another advantage of the invention is to provide a system for adjusting the nip or sealing pressure in the press section of a paper-making machine, which nip or sealing pressure is decreased commensurate with the maximum water removal in the press.

Yet another advantage of the invention is to provide an air press which maximizes the pressing operation without compromising the speed of production.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Figure 1:
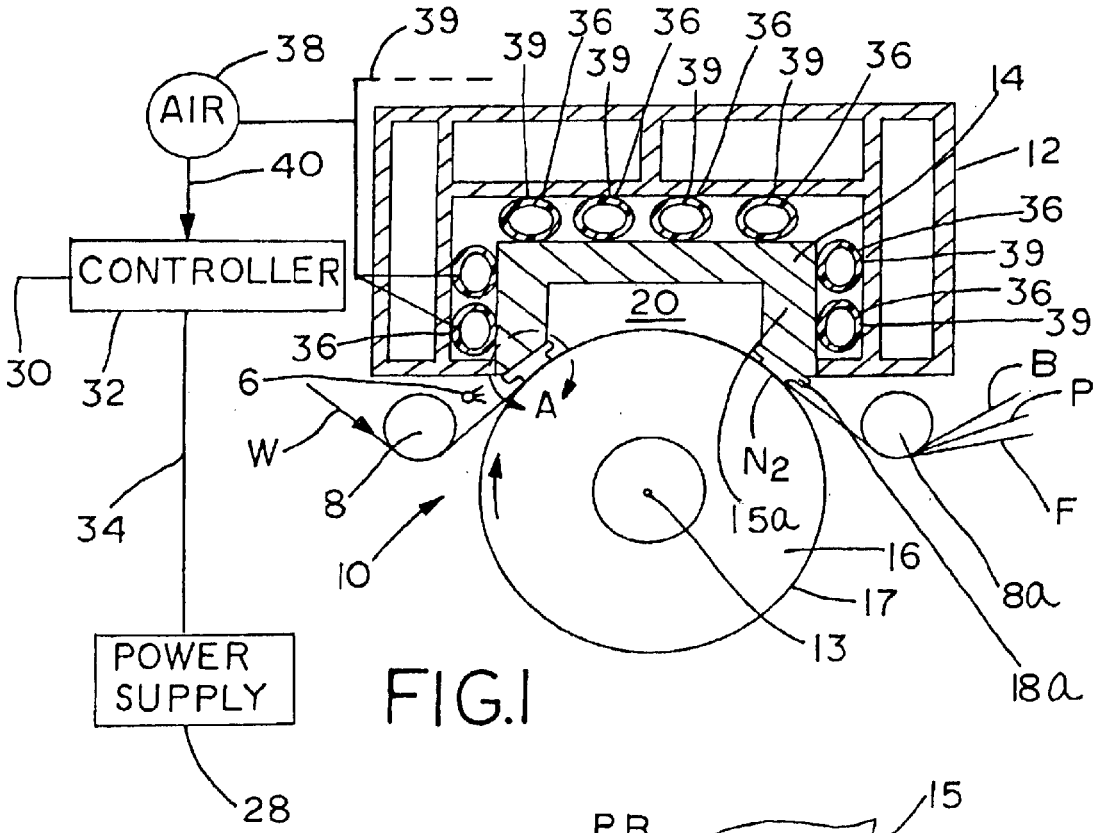
FIG. 1 is a side elevational view, partially in cross-section, of an embodiment of the invention wherein a plurality of transducers are aligned longitudinally in a seal extending in the cross-machine direction in an air press.

Corresponding reference characters indicate corresponding parts throughout the several views. The exemplifications set out herein illustrate one preferred embodiment of the invention, in one form, and such exemplifications are not to be construed as limiting the scope of the invention in any manner. If needed for clarity, different alphabetical letter postscripts are used.

DETAILED DESCRIPTION OF THE INVENTION

Figure 1A:
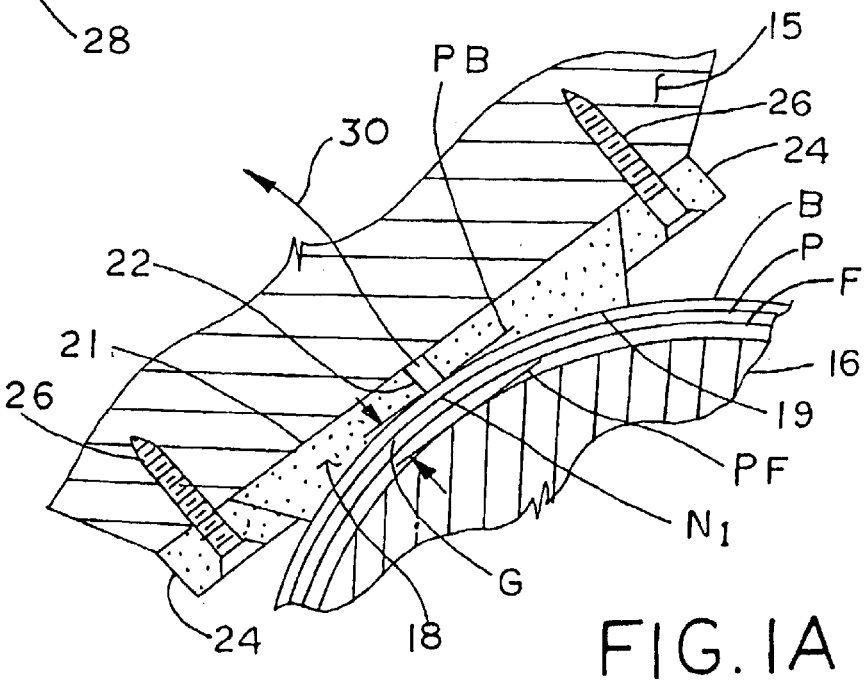
FIG. 1A is a side elevational view taken at "A" in FIG. 1 showing the seal and a transducer in more detail.

Referring now to the drawings, as shown in FIGS. 1 and 1A, a traveling composite web W is guided over a guide roll 8 to begin its processing in an air press apparatus 10, and subsequently over guide roll 8A.

Air press apparatus 10 includes a frame 12, a U-shaped pressure body 14 having a pair of spaced, parallel arms 15, 15*a* which extend toward a rotatable support roll 16. On the ends of leading and trailing arms 15, 15*a* are mounted a seal 18, 18*a*, respectively, canted to bear tangentially against the composite web W when the web is disposed to be carried on the surface of support roll 16 during operation as support roll 16 rotates about its axis 13. Seals 18, 18*a* are secured with their flat back surfaces 21 to the distal ends of arms 15, 15*a* by wedges 24 and screws 26.

Seals 18, 18*a* define, with the pressure body 14 (including the lateral sides thereof) and composite web W, a pressure chamber 20. The composite web W is formed of a flexible belt B, the flexible felt F with a nascent paper web P disposed in between. The belt B is positioned to be between the paper web P and curved surfaces 19, 19*a* of the seals to prevent abrasion between the seal surfaces and the paper web as the composite web W passes through the nip N1, N2 between each respective seal 18, 18A. An optional water shower 6 provides lubrication between belt B and the curved surface of seals 18 and 18A. In an alternative embodiment the positions of felt F and belt B are transposed.

Surface 19 of seals 18, 18A is contoured to substantially curve to conform with the cylindrical surface of support roll 16. To accommodate the lubricating qualities of the water shower, the curvature of the outer, belt-contacting surface of seals 18, 18A might be somewhat larger than the radius of the surface of support roll 16. At least surface 19 of seals 18, 18A is made of a hard, wear-resistant material, such as a ceramic. However, the entire seal could be made of a ceramic.

As shown more clearly in FIG. 1A, in the face of at least one of seals 18, 18A is a transducer 22 which is linked to a controller 32 by line 30. Power supply 28 is linked with controller 32 by a line 34. Transducer 22 is preferably an inductive or magnetic type, but may be a pressure type.

Intermediate frame 12 and body 14 are a plurality of flexible, expandable and contractible tubes 36 disposed on three sides, including 15, 15*a*, of pressure body 14. A source of pressurized air, such as pump 38, is linked with the plurality of tubes 36 via corresponding air lines 39, and controlled by controller 32 via line 40.

With further reference to FIG. 1A, there is a gap G between the curved surfaces 17, 19 of support roll 16 and seals 18, 18A, respectively. At the location of pressure transducer 22, gap G is measured normal to planes PB, PF tangent to the outer curved surface of belt B against seal 18 or 18A and tangent to the surface of felt F against support roll 16.

The presence of belt B, paper sheet or web P and felt F in the space forming the gap between seal 18 or 18A and support roll 16 creates a force or pressure nip between seal 18 or 18A and support roll 16. Since belt B and felt F are manufactured to exacting standards, any variation in the caliper of the web is reflected in a corresponding variation in the gap and nip pressure at the location of the variation.

Figure 2:
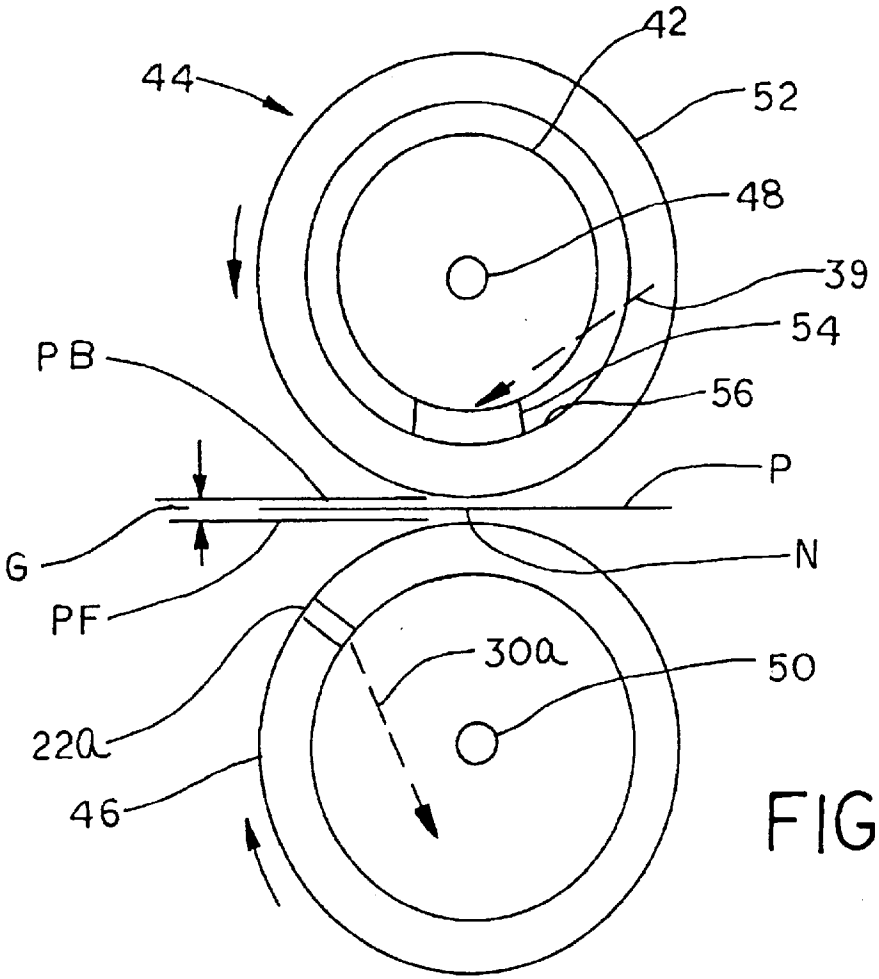
FIG. 2 is a side elevational view in partial schematic form of another embodiment of this invention showing an upper control deflection roll in nipping engagement with a support roll which has a transducer mounted in its surface.
Figure 3:
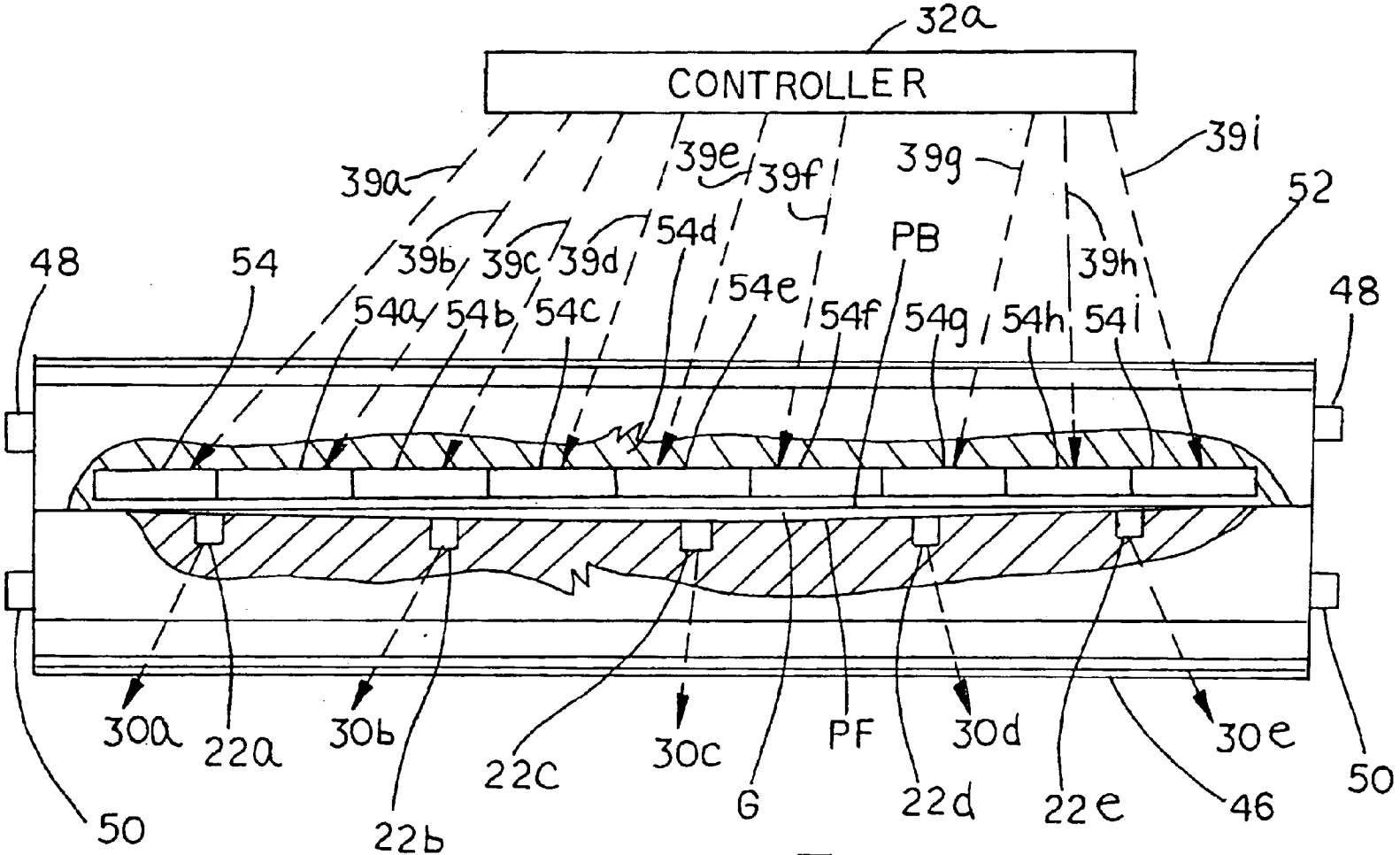
FIG. 3 is a front elevational view of the apparatus shown in FIG. 2.

Another embodiment is shown in FIGS. 2 and 3. In this embodiment, the frame includes the center shaft 42 of a so-called controlled deflection roll 44 which serves as the pressure roll in a nipped-roll couple. A support roll 46 forms a gap G with roll 44 when rolls 44, 46 are engaged along a nip line of contact N as shown in FIG. 2. Support roll 46 has a plurality of sensors in the form of transducers 22*a* . . . 22*e* mounted in its surface. Both rolls 44, 46 have journals 48, 50, respectively, about which the hollow, cylindrical roll shell 52 of the controlled deflection roll, and support roll 16 rotate.

Controlled deflection roll 44 has a plurality of end-aligned shoes 54, 54*a*, 54*b* . . . 54*i* extending longitudinally of roll 44 so as to be arrayed in the cross-machine direction when controlled deflection roll 44 is in an operating position. Shoes 54*a*–54*i* are individually linked to controller 32*a* via lines 39*a*, 39*b* . . . 39*i*. These shoes are individually actuated which in turn controls the corresponding contour of the face surface and nip line of contact with roll 46.

In the surface of support roll 46 are a plurality of transducers 22*a*, 22*b* . . . 22*e* which are respectively linked via lines 30*a*–30*e* to a controller, in a manner similar to that shown in FIGS. 1, 1A. The individual transducers can accordingly measure the gap at their respective locations across the face of the support roll.

In operation, with reference to FIGS. 1, 1A, the traveling composite web is guided by guide roll 8 into the interface between the curved surface of seal 18 and the surface of support roll 16. The composite web W comprises a traveling paper web P held between a substantially impervious belt B on its upper side against the seal, and a substantially pervious felt F against the support roll. The thickness of the composite web creates a gap between seal 18 and support roll 16.

The air pressure in actuators in the form of flexible tubes 36 on pressure body 14 produces a nip pressure against the paper web P in gap G. This seals the air pressure in chamber 20 against modification of the air pressure from an air source 38 to tubes 36 to increase, decrease or maintain the desired nip load and corresponding gap G. Gap G is measured by the pressure on transducer 22 which in turn signals controller 32 to control the air pressure from air source 38, acting in tubes 36.

Such action maintains maximum and consistent paper bulk through the seal nip consistent with the dehydration desired over the pressurized air in air press chamber 20.

In operation of the embodiment shown in FIGS. 2 and 3, a plurality of transducers are mounted in the surface of the support roll to produce signals over lines 30*a* . . . 30*e* indicative of gap G at longitudinal locations along the nip line between support roll 46 and controlled deflection roll 44. Measurement of gap G is done in the same general manner as described in conjunction with the embodiment shown in FIGS. 1, 1A utilizing signals to and from controller 32, via lines 30.

Control of the measured gap or nip at corresponding cross-machine locations along the length of the roll faces is accomplished by the controller signaling actuators in the form of individual shoes 54*a* . . . 54*i* via lines 39*a*–39*i* within controlled deflection roll 44 to provide increased or decreased shoe actuation pressure against inside surface 56 of hollow cylindrical roll shell 52 of controlled deflection roll 44. This action adjusts gap G at one or more locations along the longitudinal working length of the nipped rolls 44, 46, as desired, according to the corresponding gap measurements. Such control of the measurement of gap G also affords corresponding control of the nip load against the composite web W and paper web P to provide the stated advantages as well as other advantages readily discernable by those skilled in the art.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A control system for measuring a gap in an apparatus for pressing a traveling paper web, comprising:

a support roll and a press apparatus, said press apparatus including a pressure body, said pressure body and said support roll defining the gap therebetween, said support roll positioned underneath said paper web;

a frame movably supporting the pressure body;

an actuator operatively disposed between the frame and pressure body for selectively moving the pressure body toward and away from the support roll to control the gap size;

a sensor mounted in the press apparatus for producing a signal indicative of the pressure on the paper web as the paper web is passed through the gap adjacent said sensor; and a controller operatively linked with the sensor for receiving the signal, determining the measure of the gap as a function of the pressure, and causing the actuator to move the pressure body to control the gap size.

2. A control system for measuring a gap as set forth in claim 1, further including a belt interposed between the paper web and the press apparatus; and the press apparatus includes an air chamber for applying pressurized air to the belt.

3. A control system for measuring a gap as set forth in claim 1, wherein the support roll comprises a rotatable support roll having a cylindrical support surface; and the pressure body includes a seal which has an outer surface contoured to substantially conform with a support surface of the support roll.

4. A control system for measuring a gap as set forth in claim 1, wherein said sensor comprises a transducer.

5. A control system for measuring a gap as set forth in claim 4, wherein the pressure body includes leading and trailing arms; a seal is mounted on a distal end of at least one of the leading or trailing arms for contacting one of a belt and a felt in nipping engagement therewith; and the transducer is mounted in the seal of at least one of the leading or trailing arms for producing signals indicative of the gap between the press apparatus and the support.

6. A control system for measuring a gap as set forth in claim 1, wherein the paper web is disposed to travel between a belt and a felt; the support roll comprises a support roll having a roll surface; the pressure body includes a seal having a surface curved for engaging the belt over the support roll surface; and the sensor includes a transducer operatively mounted in the seal curved surface for engaging the belt and producing a signal indicative of the gap between the seal surface and the support roll surface as the belt, paper web and felt are passed therebetween.

7. A control system for measuring a gap as set forth in claim 6, wherein said sensor is a pressure transducer coupled with a controller, which in turn is coupled with a source of pressurized air whereby the controller controls said source of pressurized air to provide a predetermined air pressure as a function of the pressure transducer signal to produce a corresponding force in the pressing apparatus and seal to maintain the gap at a predetermined size as measured by the pressure transducer.

8. A control system for measuring a gap as set forth in claim 1, wherein the actuator comprises at least one flexible tube capable of expanding or contracting upon being linked with a source of pressurized air to selectively apply force to move the pressure body to control the gap size.

9. A control system for measuring a gap as set forth in claim 8, wherein the pressure body includes a seal for contacting one of a belt and a felt in nipping engagement therewith.

10. A control system for measuring a gap as set forth in claim 9, wherein the seal has an outer surface for engaging one of the belt and the felt, the seal outer surface being contoured to conform with the support roll.

11. A control system for measuring the gap as set forth in claim 10, wherein the seal outer surface is curved to be cylindrical with a radius of curvature at least as large as the radius of curvature of the support roll surface.

12. A control system for measuring a gap in an apparatus for pressing a traveling paper web as the paper web travels through the gap, the apparatus including a support and a press apparatus, said press apparatus including a pressure body, said pressure body and said support defining the gap therebetween, comprising:

a frame for movably supporting the pressure body;

the support includes a support roll having a cylindrical surface, said support roll positioned underneath the paper web;

the pressure body includes an air pressure chamber having leading and trailing arms disposed to engage one of a belt and a felt to seal the air pressure chamber thereagainst;

a pressure source for providing pressurized air to the air pressure chamber for providing pressing force to the web as the web passes beneath the air pressure chamber over the support roll surface;

at least one sensor attached to at least one of the leading or trailing arms at the interface between the at least one arm and one of the felt and belt over the surface of the roll for producing a signal indicative of the pressure on the paper web as the paper web is passed proximate to said sensor; and a controller operatively linked with said pressure source and with the at least one sensor for receiving the signal, measuring the gap and selectively causing increasing or decreasing pressure on the pressure body to control the gap.

13. A control system for measuring a gap as set forth in claim 12, further including:

a seal mounted to the distal end of at least one of the leading or trailing arms, the seal having a face for bearing against one of said belt and said felt; and at least one of the sensors mounted in the face bearing against one of said belt and said felt.

* * * * *